US006553292B2

(12) United States Patent
Kokes et al.

(10) Patent No.: US 6,553,292 B2
(45) Date of Patent: Apr. 22, 2003

(54) DEVICE AND METHOD FOR PERFORMING REMOTE DIAGNOSTICS ON VEHICLES

(75) Inventors: Michael Kokes, Stuttgart (DE); Werner Schleif, Winnenden (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/218,028

(22) Filed: Aug. 14, 2002

(65) Prior Publication Data

US 2003/0036832 A1 Feb. 20, 2003

(30) Foreign Application Priority Data

Aug. 14, 2001 (DE) ..... 101 38 833

(51) Int. Cl.[7] ..... G01M 17/00
(52) U.S. Cl. ..... 701/33; 701/29
(58) Field of Search ..... 701/33, 29, 35, 701/32, 101, 114, 115; 340/438, 439, 459, 426

(56) References Cited

U.S. PATENT DOCUMENTS

| | | | | |
|---|---|---|---|---|
| 4,602,127 A | | 7/1986 | Neely et al. | |
| 6,169,943 B1 | | 1/2001 | Simon et al. | |
| 6,181,994 B1 | | 1/2001 | Colson et al. | |
| 6,192,303 B1 | | 2/2001 | Takakura et al. | |
| 6,430,485 B1 | * | 8/2002 | Hullinger | 701/33 |
| 6,459,969 B1 | * | 10/2002 | Bates et al. | 701/29 |

FOREIGN PATENT DOCUMENTS

| | | |
|---|---|---|
| DE | 35 40 599 | 5/1987 |
| DE | 37 82 165 | 3/1988 |
| DE | 195 43 784 | 5/1997 |
| DE | 19700353 | 7/1998 |
| DE | 198 53 000 | 6/1999 |
| DE | 198 48 791 | 4/2000 |
| DE | 100 28 689 | 1/2001 |
| EP | 1063 507 | 12/2000 |
| GB | 2350443 | 11/2000 |
| WO | WO 01/96146 | 2/2002 |

* cited by examiner

*Primary Examiner*—Richard M. Camby
(74) *Attorney, Agent, or Firm*—Venable; Norman N. Kunitz

(57) ABSTRACT

In summary, the invention discloses a device and a method for performing remote diagnostics on vehicles, in particular on electrical, mechanical and mechatronic components of vehicles, with which, even in the case of complicated vehicle defects and/or vehicle defects which are difficult to find, the service technician can find and recover the problem in a very short time, if necessary by means of real-time access to external databases and/or by involving a service centre so that the non-operational times in the event of a fault are minimized.

18 Claims, 3 Drawing Sheets

DEVICE AND METHOD FOR PERFORMING REMOTE DIAGNOSTICS ON VEHICLES

Figure 1:
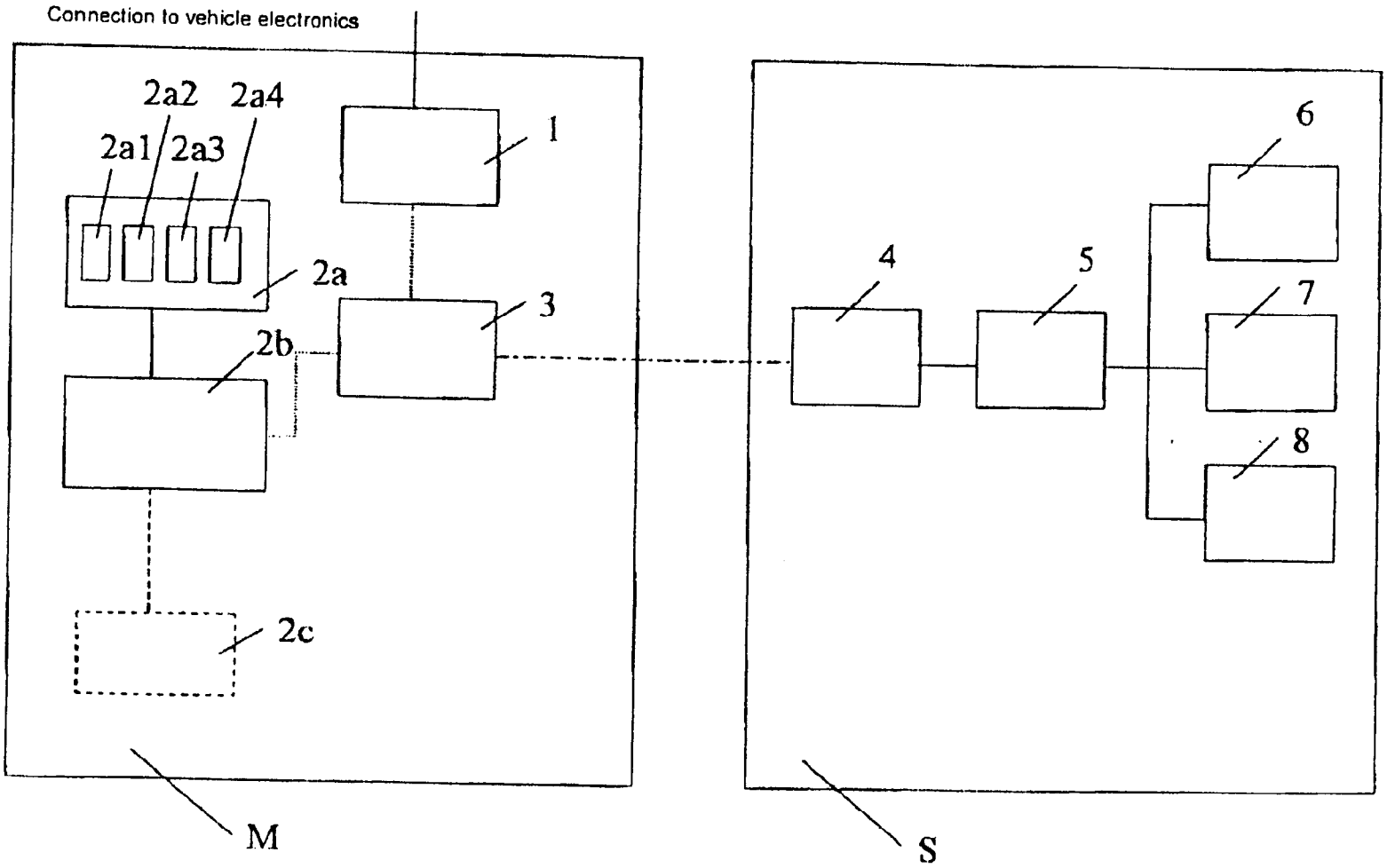

The invention relates to a device and a method for performing remote diagnostics on vehicles according to the preamble of Patent Claims 1 and 10.

Various methods and devices for performing remote diagnostics on vehicles are known from the prior art.

For example, DE 198 53 000 A1 discloses a method and an arrangement for transmitting data and for supplying motor vehicles with data. Data is exchanged and/or an interrogation, change or updating of vehicle data is carried out at fixed time intervals by means of data transmission using a wire-free data transmission device with a transceiver, a relay station and a control centre. In this way, data is transmitted which can contain information relating to the technical analysis of the brake system and other systems, the thickness of the brake linings, the oil level, the air pressure, etc.

In addition, EP 1 063 507 A2 discloses an arrangement for measuring and evaluating maintenance values of motor vehicles. In this arrangement, all the relevant data for carrying out maintenance and diagnostics on a motor vehicle, for example measured values relating to the exhaust gas of the motor vehicle, are determined at a workstation and converted into a standardized form. For this purpose, the workstation is connected via a cable to the vehicle in order to permit data to be read out. The standardized data is then fed via a data transmission device to a central computer where the measured values are then evaluated. The result of the evaluation is then transmitted back via the same data transmission device to the workstation and displayed there. The central computer contains not only the respective latest data of the relevant motor vehicles but also the respective latest program for evaluating the data.

DE 100 24 190 A1 also discloses a diagnostics device, in particular for a power transmission device, for a motor vehicle with an engine, a gearbox and a clutch. This diagnostics device has a computer in situ which is connected via a cable to a control unit of a motor vehicle so that data can be read out of the control unit and transmitted there. The computer in situ is accessed by a central computer via a computer network or the Internet by means of a central computer. Via the central computer, it is possible to access the control unit of the device on which diagnostics are to be performed, and specific interactions can be carried out. Moreover, the central computer can access a support database.

In addition, U.S. Pat. No. 6,192,303 B1 discloses a portable vehicle diagnostics unit. This diagnostics unit is connected via a cable to an electronic control unit which is mounted in a vehicle. In order to perform diagnostics on the vehicle, the portable diagnostics unit is used, from which diagnostics data is fed in wire-free fashion for processing to a processing computer for carrying out diagnostics.

DE 195 43 784 A1 discloses a device for recording, displaying and outputting data within the scope of a vehicle diagnostics. This device has a portable unit with a receiver for data signals which can be transmitted in wire-free fashion, a screen for displaying data and/or information relating to data, and a transmitter for outputting data signals which can be transmitted in wire-free fashion. Using the portable unit, the vehicle can be interrogated directly and without setting up a cable connection. The data of the motor vehicle is output from fault memories and the like and displayed on the screen. The portable unit controls the outputting of the data by the vehicle. In addition, the portable unit can input the read-out data into a diagnostics tester and/or a data network which is connected, for example, to an order receiver and permits a repair order to be made.

Furthermore, U.S. Pat. No. 6,169,943 B1 discloses a motor vehicle diagnostics system using a manual remote control. The vehicle has a storage device in which functional data relating to the state of the vehicle is stored. In the case of a malfunction, the functional data is transmitted by a control circuit in the vehicle by means of a radiofrequency signal using the DECT protocol. The radiofrequency signal is received at a telephone and the functional data is restored. The telephone transmits the functional data over a telephone network to a diagnostics computer system which analyses the functional data in order to diagnose the reason for the malfunction. The results of the diagnostics are transmitted back to the vehicle in order to be able to display them to the operator, or initiate a correction by the control circuit.

U.S. Pat. No. 6,181,994 finally discloses a method and a system for performing advanced diagnostics. Here, diagnostics information is transmitted on request by a vehicle into a diagnostics centre and advanced diagnostics routines can also be loaded into the vehicle when necessary, and the result data transmitted back into the diagnostics centre. The data is transmitted via mobile telephones, wire-free connections and Internet access via a wire-free communications link while the vehicle is on the road.

Thus, a wide variety of devices and methods for cord-bound or cordless reading-out of vehicle data by means of mobile units is known from the prior art. The diagnostics are then carried out in a remote computer which is at a distance from the location of the vehicle, with reference to this read-out vehicle data, it being possible to transmit diagnostics information back to the read-out device and/or the vehicle and display it for a service technician.

However, in the known devices and methods for performing remote diagnostics on vehicles there is the problem that diagnostics are carried out only with reference to the read-out vehicle data and then the diagnostics result which is determined in an external processing device is displayed. However, these diagnostics are possible only for electrical components. Apart from this displayed diagnostics result, the service technician does not receive any help, so that frequently a time-consuming search for faults becomes necessary, which search significantly increases the non-operational time of the vehicle. Furthermore, in the event of a breakdown a driver does not receive any information about a possible problem recovery or any other source of help.

Therefore, the object of the present invention is to provide a device and a method for performing remote diagnostics on vehicles with which non-operational times during servicing or in the event of a breakdown can be reduced.

According to the invention, this object is achieved by means of a device and a method for performing remote diagnostics having the features of Patent Claims 1 and 10.

With the device according to the invention and the method according to the invention for performing remote diagnostics on vehicles it is possible for a service technician himself, on the one hand, to access locally in a direct fashion all the data, i.e. data from vehicle storage devices and data which is helpful for a repair, and, on the other hand, also to access help in an expert centre at any time without loss of time if this information is not adequate. Furthermore, in the event of a breakdown a driver is provided with information on problem recovery or another source of help. In addition, the diagnostics of mechanical and mechatronic components in conjunction with the specialist becomes easier for the service technician. As a result, in both cases, the non-operational times up to the restoration of availability can be significantly reduced.

Figure 2A:
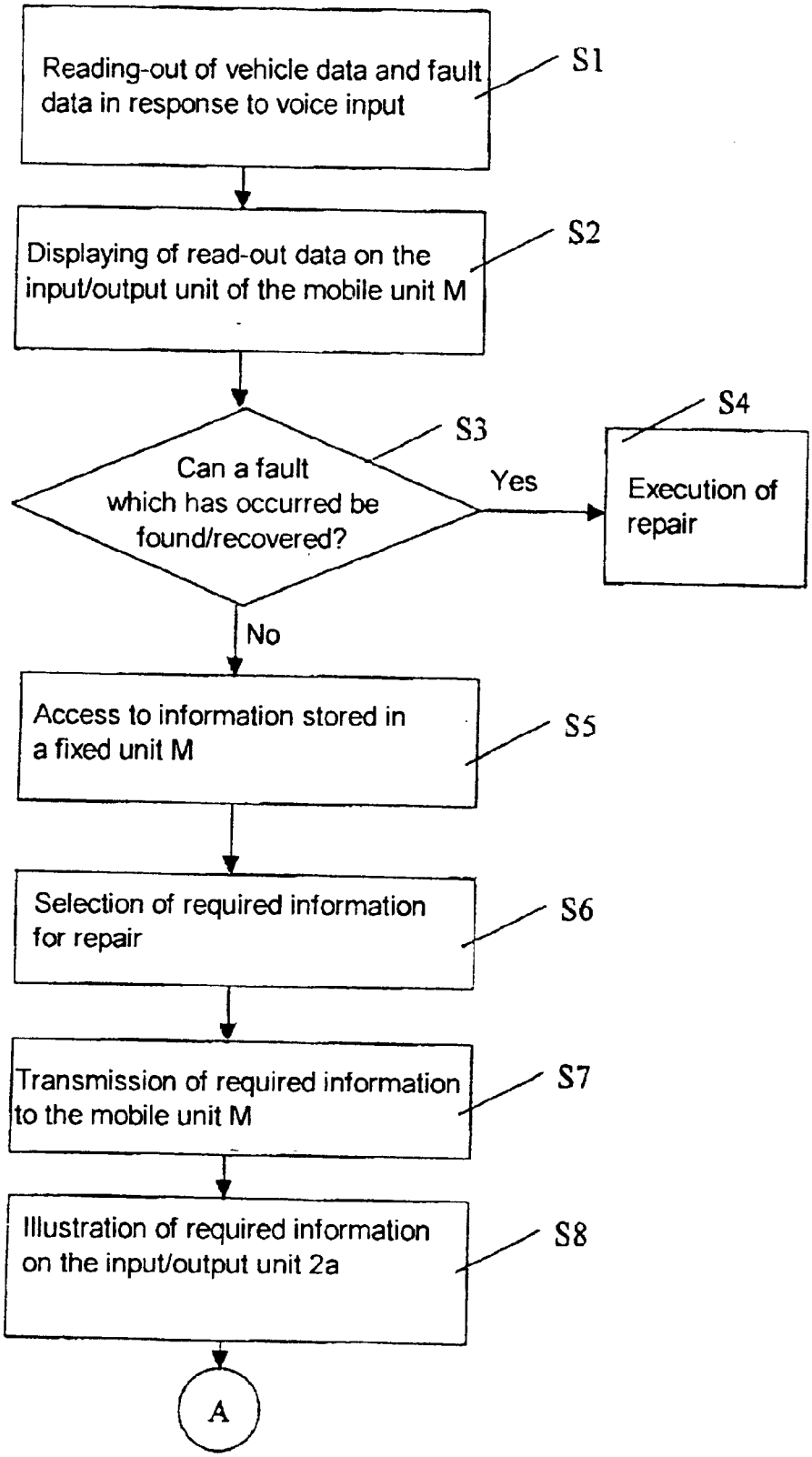
Figure 2B:
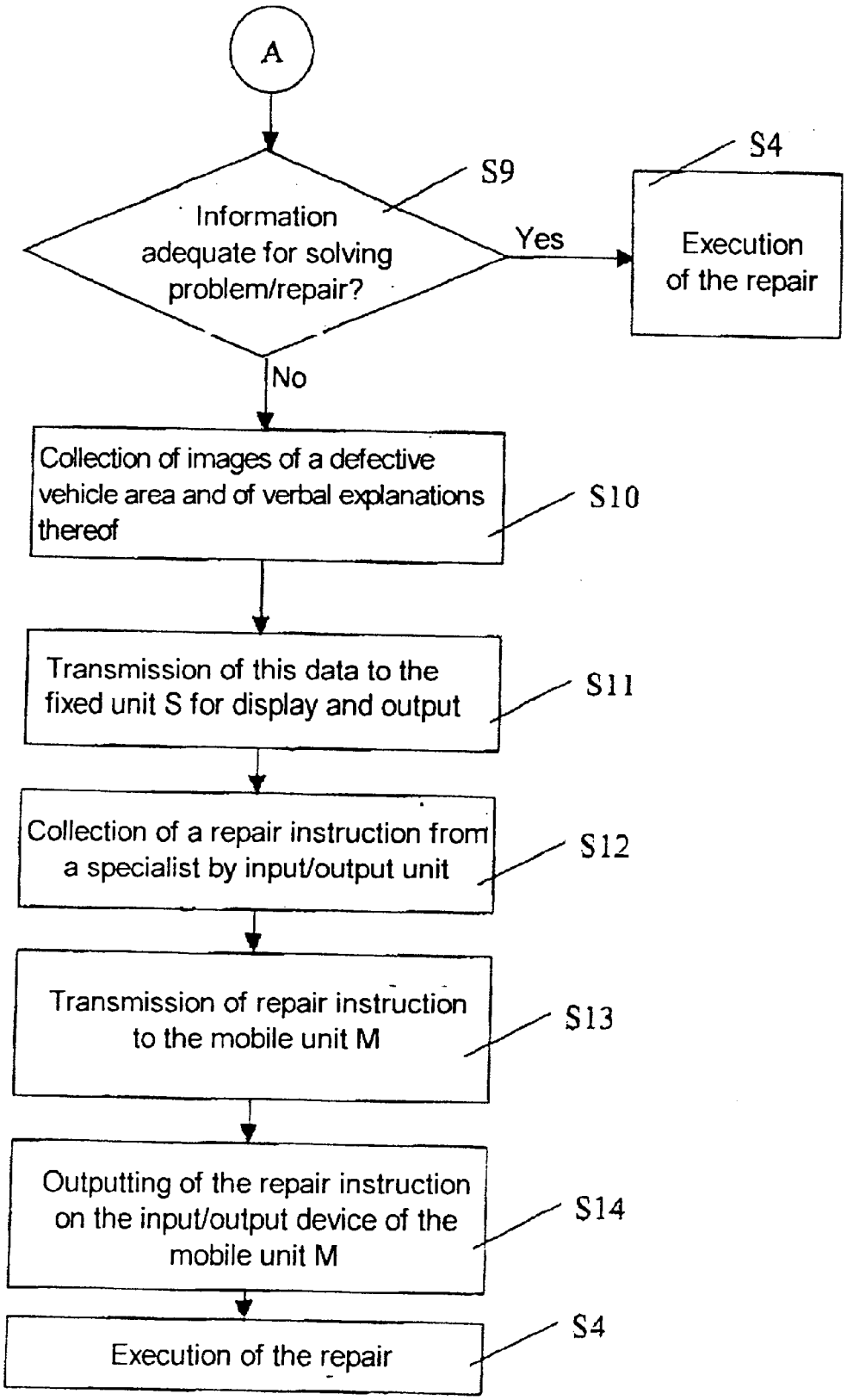

This object, and further objects, features and advantages of the invention become apparent from the following description of a preferred exemplary embodiment of the invention in conjunction with the drawing, in which:

FIG. 1 shows a block circuit diagram of a device according to the invention for performing remote diagnostic and FIGS. 2*a* and 2*b* show the sequence of the method according to the invention for performing remote diagnostics.

An exemplary embodiment of a device according to the invention for performing remote diagnostics will now be described more precisely.

FIG. 1 shows a block circuit diagram of a device according to the invention for performing remote diagnostics. Essentially, the device according to the invention for performing remote diagnostics comprises a mobile unit M and a fixed unit S.

The mobile unit M comprises an adapter 1 which can be connected via cable or radio link to the vehicle on which diagnostics are to be performed and which reads out, inter alia, operational data and fault data of the vehicle from a vehicle electronics system. This adapter 1 can be either diagnostics device with a radio card, which is connected to the vehicle and is controlled by a portable small computer 2*b*, a diagnostics program being stored in the adapter 1, or a pure adapter 1 with a radio card which is used merely for reading out data from the vehicle electronics system and which can be embodied either outside the vehicle or permanently installed in it. The adapter 1 also has a transmitter device or a transceiver device, specifically the radio card mentioned above, via which the stored data can be transmitted to a receiver or transmitted and received. In the second case, it is also possible to receive data from an external transmitter. In addition, the mobile unit M comprises a portable diagnostics device 2 which is composed of an input/output unit 2*a* with camera 2*a*1, screen 2*a*2, a mobile voice output device, for example a headset 2*a*3, and a mobile voice input device, for example a microphone 2*a*4, as well as a portable small computer 2*b*. The input/output unit 2*a* and the portable small computer 2*b* each have a transceiver device for the cordless exchange of data with one another, for example by means of radio signals or the Bluetooth Standard. The portable small computer 2*b* can be freely controlled via the microphone 2*a*4 by means of voice input. Alternatively, control can also be performed via the screen 2*a*2 if the latter is embodied as a touch-sensitive screen. All the software for carrying out diagnostics on vehicle data read out from the vehicle is stored in a storage device of the portable small computer. In the event of a data transmission to the fixed unit S via Intranet, Internet, a telephone line, etc., [lacuna] takes place between the portable diagnostics device 2 and the adapter 1 via a base station 3 to the fixed unit S, and otherwise the data is transmitted directly from the portable diagnostics device to the fixed unit, for example by means of GSM or satellite transmission.

The fixed unit S has a network input node 4 in which all the data transmissions are received irrespective of which of the transmission paths mentioned above may have been transmitted on from the mobile unit M to the fixed unit S; either a transceiver device is set up for this or the data is fed directly to the network input node 4—if it is technically possible and no conversion is necessary. Furthermore, a personal computer 5, which may alternatively also be a workstation or a notebook, is embodied with a screen 6 and a voice input/output device 7 with a voice output device 7*a*, for example a headset, and a voice input device, for example a microphone 7*b*. The voice input/output device 7 can be connected, either via cable or in cordless fashion, to the personal computer 5 using identical techniques to those used for the input/output unit 2*a* of the portable diagnostics device. In addition, a storage device 8 is provided in which databases with information relating to circuit diagrams, repair instructions, decision aids (for example a description of problems which occur rarely and their recovery, failure statistics of vehicle elements relating to the service life, . . . ), etc. are stored. The personal computer 5 and the storage device 8 are connected to the network input node 4 so that both can be accessed from the portable small computer 2*b*.

In one advantageous development of the invention, the mobile unit M is permanently installed in a vehicle on which diagnostics are to be performed and connected to the vehicle electronics so that continuous access to the vehicle data and fault data is possible, and additionally has a monitoring device 2*c* which is connected to the portable personal computer 2*b* and receives the present vehicle data via said personal computer 2*b* and determines whether there is a deviation which indicates a fault. When such a deviation is determined, the portable personal computer 2*b* is informed of it and initiates automatic transmission of the vehicle data and fault data to the fixed unit S.

All the connections which are shown with an unbroken line in FIG. 1 between the individual elements of the mobile unit M can be embodied either as a cable or as a radio link. Only the connections which are represented as dashed lines between the adapter 1 and base station 3 as well as between the base station 3 and portable personal computer 2*b* have to be embodied as radio links in order to ensure the unrestricted freedom of movement of the service technician. The connection between the mobile M and the fixed unit S may be a link such as is necessary either for an Internet link, an Intranet link, a telephone line, GSM, UTMS, GPRS or satellite transmission.

More details on the function of the device described above for performing remote diagnostics and the method according to the invention for performing remote diagnostics will be given below with reference to the flowchart shown in FIGS. 2*a* and 2*b*.

If a vehicle is in a workshop for servicing, the service technician uses a voice input into the microphone 2*a*4 via the portable personal computer 2*b* with intermediately connected base station 3 to read out from the adapter 1 (S1) in which the vehicle data including fault data is stored. The read-out vehicle data, in particular the fault data, is then displayed to the service technician in a comprehensible form on the screen 2*a*2 which is associated with the portable personal computer 2*b* and with the input/output unit 2*a* therein (S2). If the service technician cannot eliminate the displayed fault or faults without further information (S3) he accesses the storage device 8 by means of a renewed voice input into the microphone 2*a*4 via the portable personal computer 2*b*, the base station 3 and the network node 4 (S5) , in order to request, for example, circuit diagrams, repair instructions, etc. from there (S6) . This data is then transmitted to the portable personal computer 2*b* and displayed on the screen 2*a*2 (S7, S8). If the service technician can still not recover the fault by reference to the information which is now present (S9), he refers, by means of a renewed voice input into the microphone 2*a*4, to a specialist who is operating the personal computer 5. He uses the camera 2*a*1 to take images of the vehicle to be repaired, and uses the microphone 2a4 to record verbal explanations of particular features which he notices, questions, etc. (S10). This information is transmitted to the personal computer 5 of the fixed unit S and output there on the screen 6 and via the voice output device 7a of the voice input/output device 7 to a specialist (S11). The response of the specialist is in turn transmitted to the portable personal computer 2b (S11, S12) and then output on the screen 2a2 and the mobile voice output device 2a3 (S14). Then, the service technician carries out the repair (S15). If he still requires further information, the sequence described above is repeated (not shown in FIG. 2).

Alternatively, if the service technician finds that his information is not adequate for a repair, for example because at first he had not recognized all the faults, he can also repeat the steps S5 to S8 (not shown) before involving the specialist.

Rapid repair is thus ensured in all cases because, if the service technician cannot carry out a repair without further information, he can, at any time, access databases and/or help from a specialist in real time. For this reason, the non-operational times for a repair are reduced, in particular in problematic cases, because the time for searching for faults can be considerably reduced.

In one preferred development of the invention, the mobile unit M is permanently installed in the vehicle. In such a case, the system can be used not only by the service technician during a customer service appointment but also by the driver in the case of a vehicle breakdown. The driver can then directly [lacuna] the data read out by the mobile personal computer 2b via the adapter 1 from the vehicle data storage devices to the fixed unit S and thus to the specialist in order to obtain information about the technical problem and any simple means of recovery. Alternatively, it is possible for the reading-out of data to be initiated from the fixed unit S as soon as it is informed of a breakdown by the driver. In this case, the inputs by the service technician and driver are differentiated, for example in that a predetermined characteristic signal is transmitted by the service technician to make a confirmation in order to inform the fixed unit S of this fact. The information on the recovery can comprise, for example, the transmission to the screen 2a2 of a repair instruction for small problems and problems which can be overcome by a nonexpert, and the communication of audio information via the speech output device 2a3. If a repair in situ is not possible, this is also communicated to the driver by means of the fixed unit S which can directly access the contents of the vehicle storage devices, provide the driver with information on the nearest workshop and optionally also make an appointment with this workshop. If the vehicle is no longer roadworthy, or can no longer be made roadworthy, a breakdown service is additionally informed. Alternatively, it is also possible to transmit a correction instruction to the vehicle control device and then merely inform the driver about the problem recovery.

In a further embodiment of the invention, the device for performing remote diagnostics has, in addition to the devices mentioned above, a language converter which is contained, for example, in the mobile personal computer 2b. By means of this language converter the driver can, in the event of a breakdown abroad, when he can only access a foreign-language fixed unit S, that is to say for example a foreign technical support centre, he can understand the information which is transmitted to him as an audio signal because it is converted into his language by the language converter. This applies, of course, also conversely for his voice information which he transmits to the fixed unit S.

In a further embodiment, in order to better represent the possibly defective part of the vehicle, a pair of cameras are embodied for recording images instead of camera 2a1, said pair of cameras being arranged in such a way that a three-dimensional image of the defective vehicle part can be generated. In this way, the specialist is provided with a better impression of the defective vehicle part on the screen 6 of the fixed unit S, can better recognize details and particular noticeable features and can give more detailed instructions to the service technician.

In a further embodiment of the invention, the camera 2a1 is constructed in such a way that it can generate not only a video image but also a high-resolution image. This method of operation is used if vehicle views or views of vehicle parts are necessary as a high-resolution image in order to document these views, for example for reasons of fair dealing or warranties, for further processing or archiving. The data which represents such a high-resolution image can be stored both by the portable personal computer 2b and by the personal computer 5. However, as a rule, archiving will take place in a storage device of the personal computer 5.

In summary, the invention discloses a device and a method for performing remote diagnostics on vehicles, in particular on electrical, mechanical and mechatronic components of vehicles, with which, even in the case of complicated vehicle defects and/or vehicle defects which are difficult to find, the service technician can find and recover the problem in a very short time, if necessary by means of real-time access to external databases and/or by involving a service centre so that the non-operational times in the event of a fault are minimized.

What is claimed is:

1. Device for performing remote diagnostics on vehicles, having:

a mobile unit (M) with:

an adapter (1) which can be connected to a vehicle on which diagnostics are to be performed and which reads out operational data and fault data of the vehicle, the adapter (1) having a transmitter device or a transceiver device via which the stored data can be transmitted to a receiver or data can be received from an external transmitter;

a mobile unit (M) with a portable diagnostics device (2) with an input/output unit (2a; 2a1, 2a2, 2a3, 2a4) and a portable small computer (2b) which each have a transceiver device for the cordless exchange of data with one another;

a base station (3) for receiving data from the adapter (1) and the mobile unit (M) and transmitting data to and receiving data from a network input node (4); and a fixed unit (S) with the network input node (4), a personal computer (5) with a display device (6) and an input/output device (7; 7a, 7b), and a storage device (8) for storing information relating to a vehicle repair.

2. Device according to claim 1, characterized in that the input/output unit (2a) has an image recording device (2a1), a display device (2a2), a voice output device (2a3) and a voice input device (2a4).

3. Device according to claim 2, characterized in that the portable small computer (2b) can be freely controlled by means of the voice input device (2a4).

4. Device according to claim 2, characterized in that the image output device is embodied as a touch-sensitive screen, and the portable small computer (2b) can be freely controlled by means of the touch-sensitive screen.

5. Device according to claim 1, characterized in that the portable small computer (2b) has a storage device in which programs for executing diagnostics of vehicle data and fault data read out of the vehicle can be stored.

6. Device according to claim 1, characterized in that the adapter (1) has a storage device in which programs for executing diagnostics of vehicle data and fault data read out of the vehicle can be stored.

7. Device according to claim 1, characterized in that the base station (3) and the network input node (4) transmit data to be exchanged between them to the respective partner via Intranet, Internet, a telephone line, by means of GSM, GPRS, UTMS, satellite transmission or comparable methods.

8. Device according to claim 1, characterized in that the information which is stored in the storage device (8) and relates to the vehicle repair contains information relating to circuit diagrams, repair instructions and decision aids such as, for example, a description of problems which occur rarely and their recovery, failure statistics of vehicle elements relating to the service life, etc.

9. Device according to claim 1, characterized in that the input/output unit **(2; 2*a*1, 2*a*2, 2*a*3, 2*a*4)** has a language converter device in which input and output voice signals are converted in such a way that they can be understood both by the transmitter and by the receiver, the voice being predefined at the mobile unit (M) end.

10. Method for performing remote diagnostics on vehicles, having the steps:

(1) reading out of vehicle and fault data from a vehicle storage device into an input/output unit **(2*a*) of a mobile unit (M) in response to a voice input, (2) displaying of the read-out data on the input/output unit (2*a*) of the mobile unit (M), (3) if a fault which has occurred cannot be found and/or recovered by means of this data, accessing of information stored in a fixed unit (S) in response to a renewed voice input into the input/output unit (2*a*) of the mobile unit (M), selection of the required information in accordance with the data read out from the vehicle storage device, transmission of the required information to the mobile unit (M) and representation of the required information on the input/output unit (2*a*)** of the mobile unit (M), and (4) execution of a repair using the represented, required information.

11. Method according to claim 10, characterized by the further steps (5) if the information stored in the fixed unit (S) does not contribute to the solution of the problem, and therefore a repair cannot be carried out, collection of images of a possibly defective vehicle area and of voice explanations relating to these images, and transmission of this data to the fixed unit (S) to be displayed and output by an input/output unit (6, 7) of the fixed unit (S) in order to permit analysis by a specialist, (6) collection of a repair instruction of the specialist via the input/output unit (6, 7) of the fixed unit (S) and transmission of this repair instruction to the mobile unit (M) and outputting of the repair instruction on the input/output device **(2*a*)** of the mobile unit (M), and (7) execution of the repair in accordance with the repair instruction which is output.

12. Method according to claim 10, characterized in that the information which is accessed in response to a voice input comprises circuit diagrams, repair instructions, a description of problems which occur rarely and their recovery, etc.

13. Method according to claim 10, characterized in that if the represented, required information is, contrary to expectations, not sufficient for a repair, step (3) is executed again.

14. Method according to claim 10, characterized in that if the repair instruction of the specialist is not sufficient, steps (5) and (6 ) are repeated.

15. Method according to claim 10, having the further steps (0) before a step (1) monitoring of the vehicle function, detection of a fault which occurs and in response thereto automatic initiation of steps (1) and (3) by the mobile unit (M), the mobile unit (M) being built into the vehicle.

16. Method according to claim 11, characterized in that in the event of breakdown a driver initiates execution of steps (1), (5), (6) and (7).

17. Method according to claim 16, characterized in that the fixed unit (S) initiates the following if the specialist detects that a repair is not possible by the driver: agreement of a workshop appointment and transmission and display of this appointment and of the position/the route to the workshop on the input/output unit **(2*a*)** of the mobile unit (M) and, if the vehicle is no longer roadworthy, or can no longer be made roadworthy, provision of information to a breakdown service.

18. Method according to claim 15, characterized in that the fixed unit (S) initiates the following if the specialist detects that a repair is not possible by the driver: agreement of a workshop appointment and transmission and display of this appointment and of the position/the route to the workshop on the input/output unit **(2*a*)** of the mobile unit (M) and, if the vehicle is no longer roadworthy, or can no longer be made roadworthy, provision of information to a breakdown service.

* * * * *